US005732832A

United States Patent [19]

Kordowski

[11] Patent Number: 5,732,832

[45] Date of Patent: Mar. 31, 1998

[54] ADJUSTABLE DIVIDER UNIT TO SUPPORT NOTEBOOKS

[76] Inventor: John J. Kordowski, 6711 Duquaine Ct., Nashville, Tenn. 37205

[21] Appl. No.: 461,261

[22] Filed: Jun. 5, 1995

[51] Int. Cl.[6] ..... A47B 65/00

[52] U.S. Cl. ..... 211/43; 211/184

[58] Field of Search ..... 211/43, 184; 108/61

[56] References Cited

U.S. PATENT DOCUMENTS

| | | | |
|---|---|---|---|
| 551,642 | 12/1895 | Kliene . | |
| 660,264 | 10/1900 | Storm | 211/184 |
| 1,030,279 | 6/1912 | Browne . | |
| 1,469,050 | 9/1923 | Pauk . | |
| 1,506,204 | 8/1924 | Snoddy . | |
| 1,508,610 | 9/1924 | O'Connor . | |
| 2,197,789 | 4/1940 | Dalton . | |
| 2,522,483 | 9/1950 | Plack | 45/28 |
| 2,747,959 | 5/1956 | Ingelson | 211/184 X |
| 2,855,258 | 10/1958 | Moncier | 312/140.3 |
| 2,944,678 | 7/1960 | Grantham | 211/177 |
| 3,269,558 | 8/1966 | Hess | 211/184 |
| 3,300,057 | 1/1967 | Wheaton | 211/184 |
| 3,850,303 | 11/1974 | Franklin | 211/43 X |
| 3,905,485 | 9/1975 | Dean et al. | 211/184 |
| 3,999,663 | 12/1976 | Walter et al. | 211/175 |
| 4,178,047 | 12/1979 | Welch | 312/140 |
| 4,410,093 | 10/1983 | Chairiello et al. | 211/11 |
| 4,552,272 | 11/1985 | Field | 211/88 |
| 4,560,072 | 12/1985 | Burrell | 211/75 |
| 4,595,105 | 6/1986 | Gold | 211/43 |
| 4,611,720 | 9/1986 | Staab | 211/60.1 |
| 4,759,449 | 7/1988 | Gold | 211/43 |
| 4,858,774 | 8/1989 | Winter | 211/184 |
| 5,207,334 | 5/1993 | Lear | 211/41 |
| 5,255,802 | 10/1993 | Krinke | 211/184 |
| 5,287,974 | 2/1994 | Buday | 211/184 |

FOREIGN PATENT DOCUMENTS

| | | | |
|---|---|---|---|
| 1461214 | 10/1966 | France | 211/184 |
| 2092884 | 8/1982 | United Kingdom . | |

*Primary Examiner*—Alvin C. Chin-Shue
*Assistant Examiner*—Sandra Snapp
*Attorney, Agent, or Firm*—Pitts & Brittian, P.C.

[57] ABSTRACT

A divider unit to support printed matter, and other objects, in a vertical orientation and whereby spacing between dividers of the unit can be easily varied. A substantially vertically oriented back member is releasable connected at its lower edge to the back edge of a base member. The base member has a support surface for the objects being held that slopes downwardly from the front edge. A plurality of dividers are held in selectable locations by the back member and the base member. This is accomplished by spaced-apart vertical slots in the back member to receive the rearward edge of the divider, and by projections in the lower edge of the divider held in spaced-apart slots in the base member. Provision is made to lock the dividers in their position to prevent inadvertent removal during removal of items therefrom. The back member is generally corrugated from top to bottom to provide the slots as well as insure rigidity. Further, a cap member is applied to the top of the back member to add rigidity. The divider unit is manufacturable using standard plastic forming techniques and can be assembled without screws, glue, bolts or tools.

11 Claims, 5 Drawing Sheets

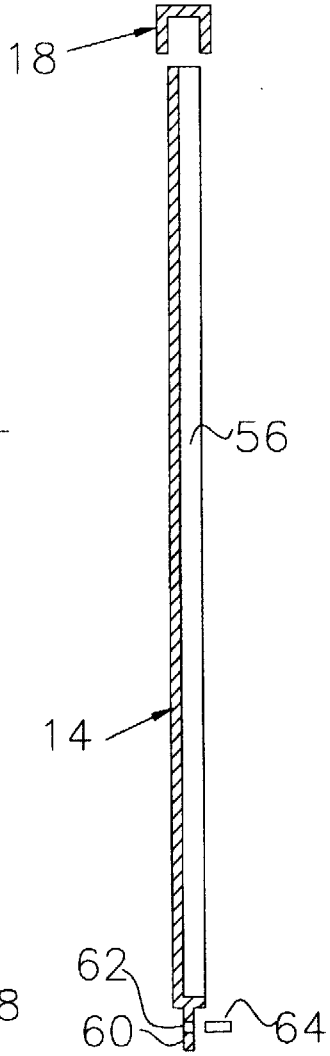
FIG. 7
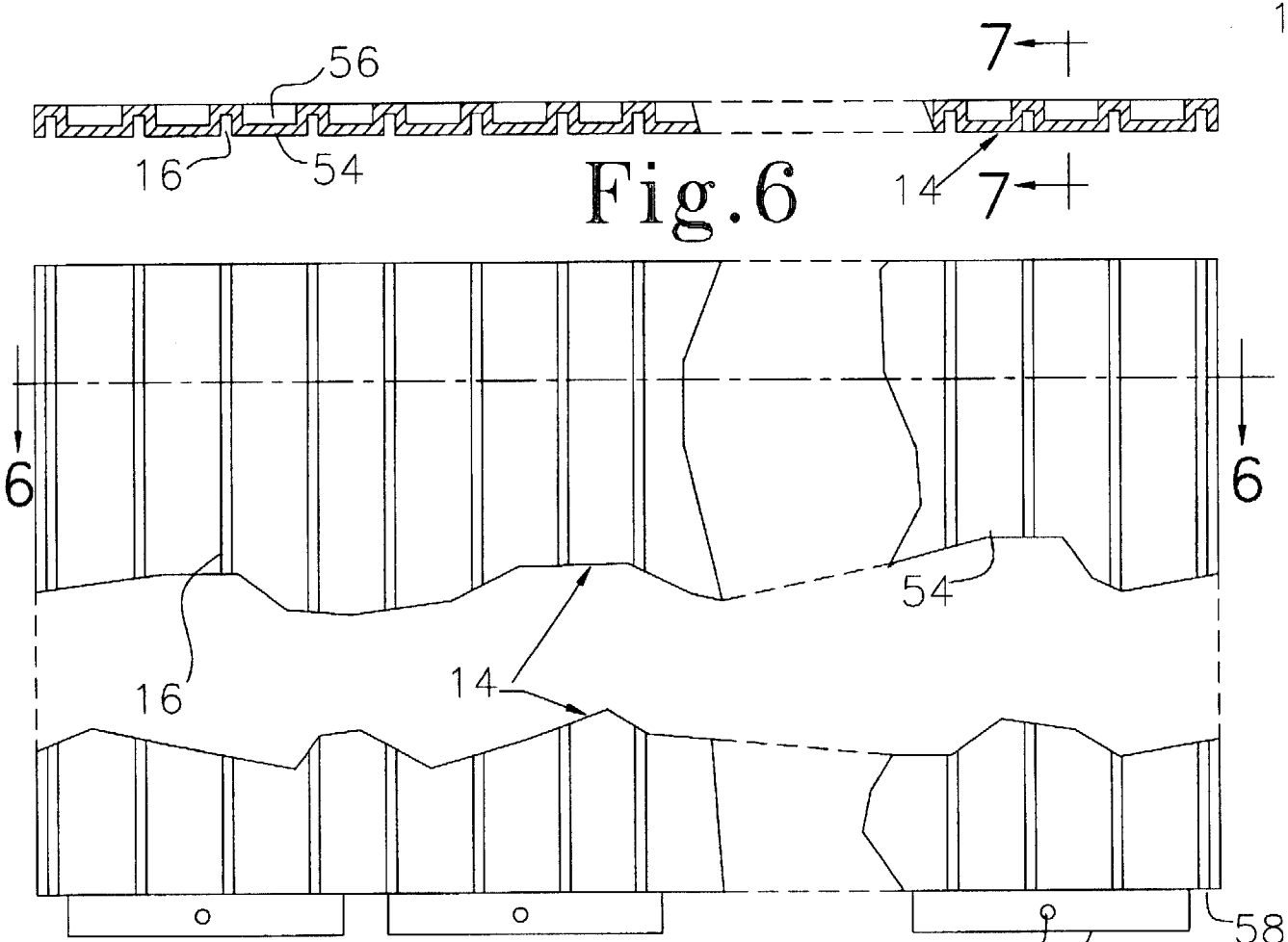
Fig. 6
FIG. 5

ADJUSTABLE DIVIDER UNIT TO SUPPORT NOTEBOOKS

TECHNICAL FIELD

The present invention relates generally to dividers for supporting objects in a vertical orientation, and more particularly to a multi-compartment support for notebooks and the like that permits an adjustment to the spacing between storage compartments thereof.

BACKGROUND ART

Many technicians and sales people, as an example, collect and store a multiplicity of a variety of brochures, magazines, catalogs and other types of assembled reading matter. It is conventional practice to store these in a vertical orientation so that an individual one of the materials can be removed without handling of others. The devices used to store such materials are generally termed "bookracks" even if not used for books in the usual sense. In any unit, where there is a potential for the storage of assembled reading matter, it will be recognized that the reading matter will often vary in thickness. To utilize a total space most effectively, therefore, there should be a provision for adjusting the storage space for the reading matter according to its thickness. U.S. Pat. Nos.: 660,264 issued to E. Storm on Oct. 23, 1900; 3,905,485 issued to C. Dean et al on Sep. 16, 1975; 4,410,093 issued to D. Chairiello et al on Oct. 18, 1983; 4,611,720 issued to R. Staab on Sep. 16, 1986; 4,759,449 issued to K. Gold on Jul. 26, 1988; 4,858,774 issued to R. Winter et al on Aug. 22, 1989; 5,255,802 issued to W. Krinke et al on Oct. 26, 1993; and 5,287,974 issued to G. Buday on Feb. 22, 1994. Other patents illustrating adjustable width storage are described in U.S. Pat. Nos.: 551,642 issued to J. Kleine on Dec. 17, 1895; 1,469,050 issued to H. Pauk on Sep. 25, 1923; 1,508,610 issued to J. O'Connor on Sep. 16, 1924; 2,197,789 issued to E. Dalton on Apr. 23, 1940; 4,552,272 issued to F. Field on Nov. 12, 1985; and 5,207,334 issued to J. Lear on May 4, 1993.

It is an object of the present invention to provide an adjustable divider unit to support bound printed matter and the like in a vertical orientation so as to permit removal of a single item without removal of an adjacent item.

It is also an object of the present invention to provide an adjustable divider unit that is amenable to manufacture from molded plastic and can be easily assembled on-site without the use of bolts, screws, adhesives or tools.

Another object of the present invention is to provide an adjustable divider unit wherein storage spacing size can be selected to closely receive a single item of printed matter.

A further object of the present invention is to provide an adjustable divider unit wherein the support surface for a unit of printed matter slopes toward the rear to reduce the chance of inadvertent removal of a unit of printed matter.

It is also an object of the present invention to provide an adjustable divider unit wherein individual dividers can be moved, or removed, for spacing adjustment but wherein the individual dividers are provided with means to prevent inadvertent removal.

An additional object of the present invention is to provide an adjustable divider unit amenable to manufacture by conventional plastic forming techniques which has sufficient rigidity to be a free-standing unit to support a multiplicity of printed matter units.

These and other objects of the present invention will become apparent upon a consideration of the drawings referred to hereinafter, and to a complete description thereof.

SUMMARY OF THE INVENTION

In accordance with the present invention, there is provided a molded plastic base member that, at the rear, supports a vertically-oriented molded plastic back member. Each of these members, the base member and the back member, are provided with a series of slots to support divider members at selectable locations; i.e., the spacing between support divider members can be varied to accommodate items of different thicknesses. The slots in the back member extend substantially from the bottom edge to the top edge thereof, the slots being molded into the back member in the form of corrugations. The slots in the base member are not continuous but are formed to receive projections along a lower edge of the divider members. One of these lower edge projections can, in one embodiment, be provided with a transverse opening to receive a pin-type fastener to prevent inadvertent removal of a divider member. The dividers are each provided with a further projection at a top corner to engage a cap member covering the top edge of the back member to further secure the divider against inadvertent removal. The base member is configured so as to provide a support surface for printed matter that slopes downwardly from the front edge toward the rear edge.

BRIEF DESCRIPTION OF THE DRAWINGS

FIG. 5 is a partial elevational view of the back member of the divider system of FIG. 1 showing points of cross sections.

FIG. 6 is a cross section of the back member of FIG. 5 taken at 6—6 of FIG. 5.

FIG. 7 is a cross section of the back member of FIG. 5 taken at 7—7 of FIG. 6.

BEST MODE FOR CARRYING OUT THE INVENTION

Figure 1:
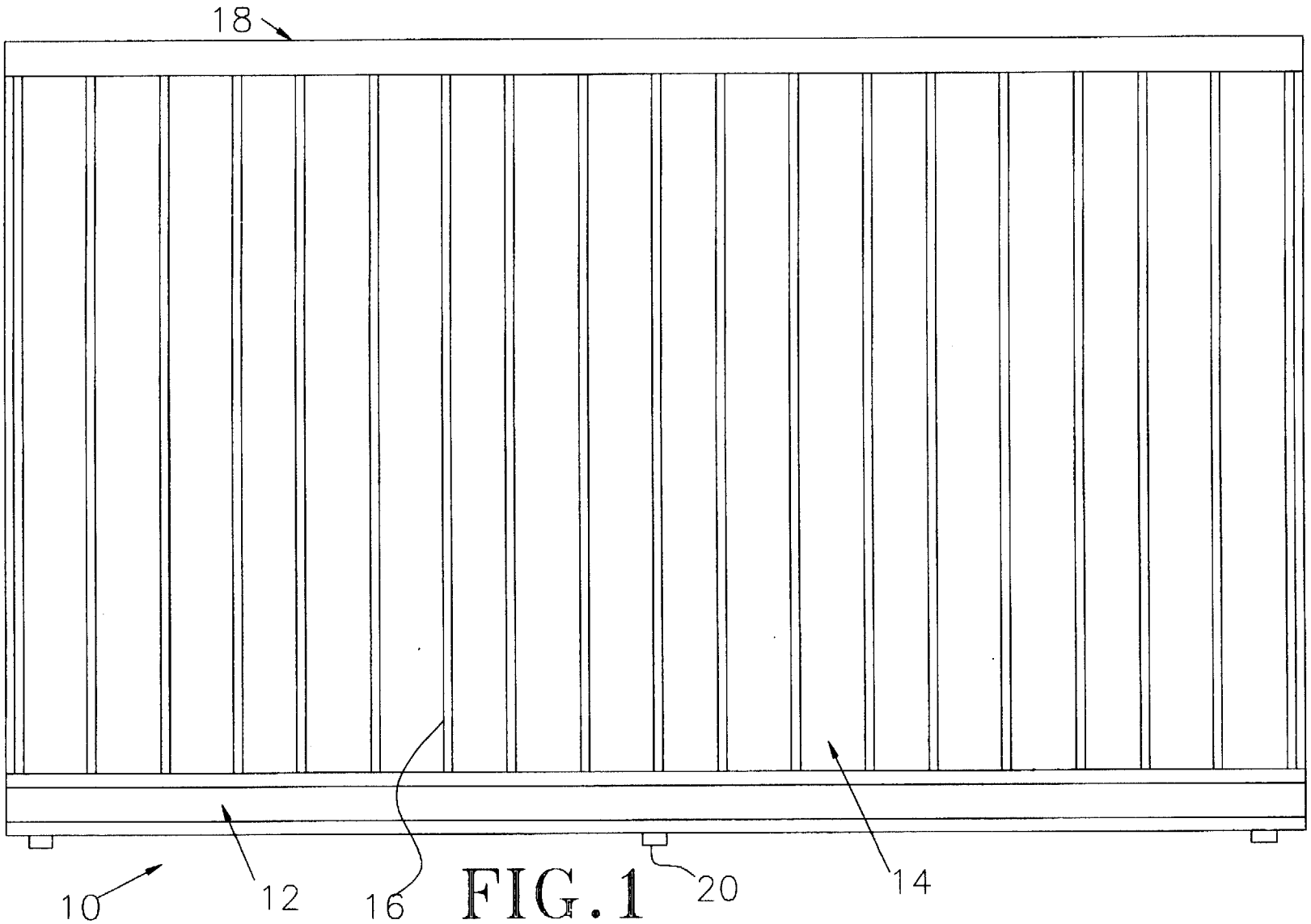
FIG. 1 is a front elevational view of a divider system according to the present invention.
Figure 2:
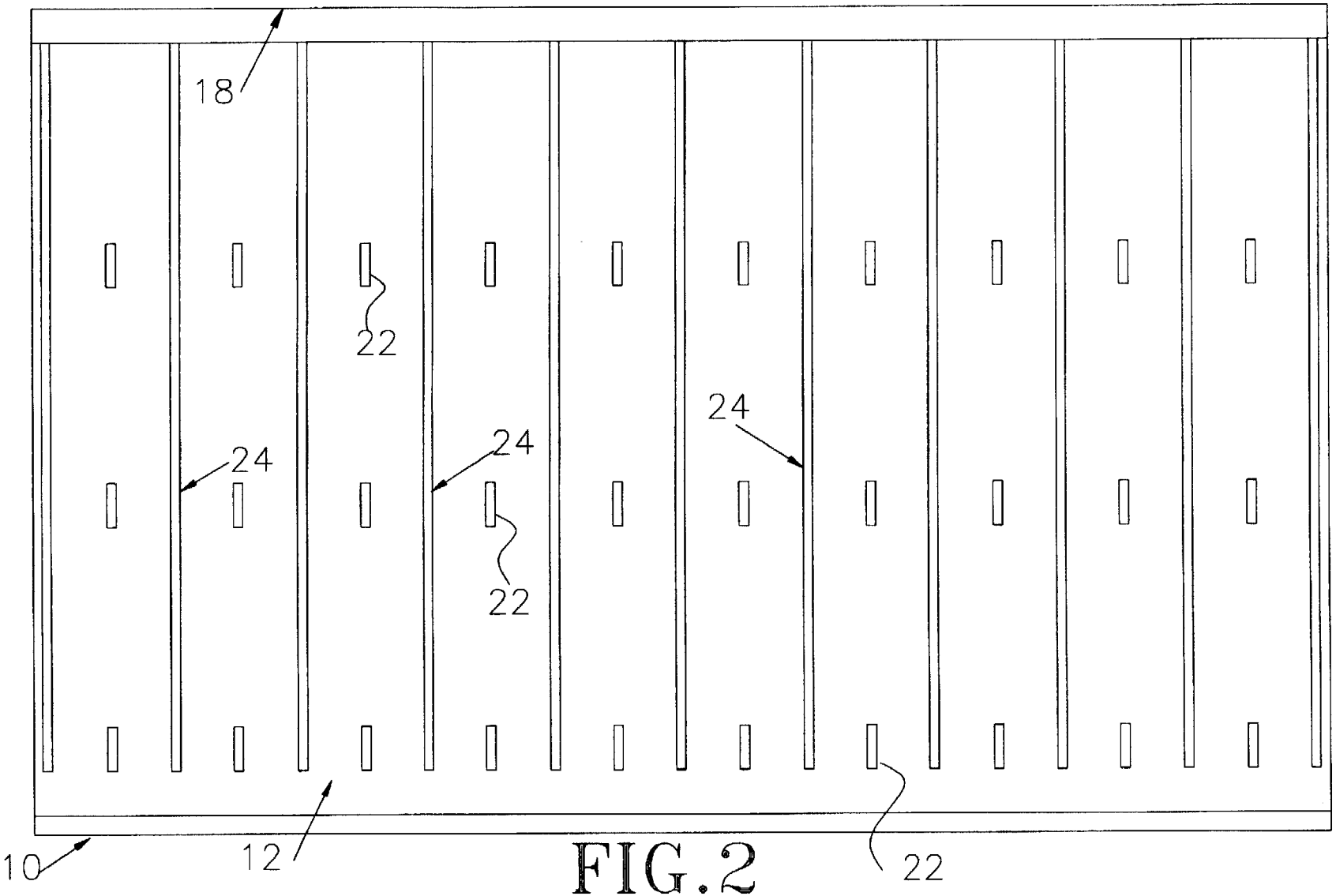
FIG. 2 is a top view of a divider system as shown in FIG. 1.
Figure 3:
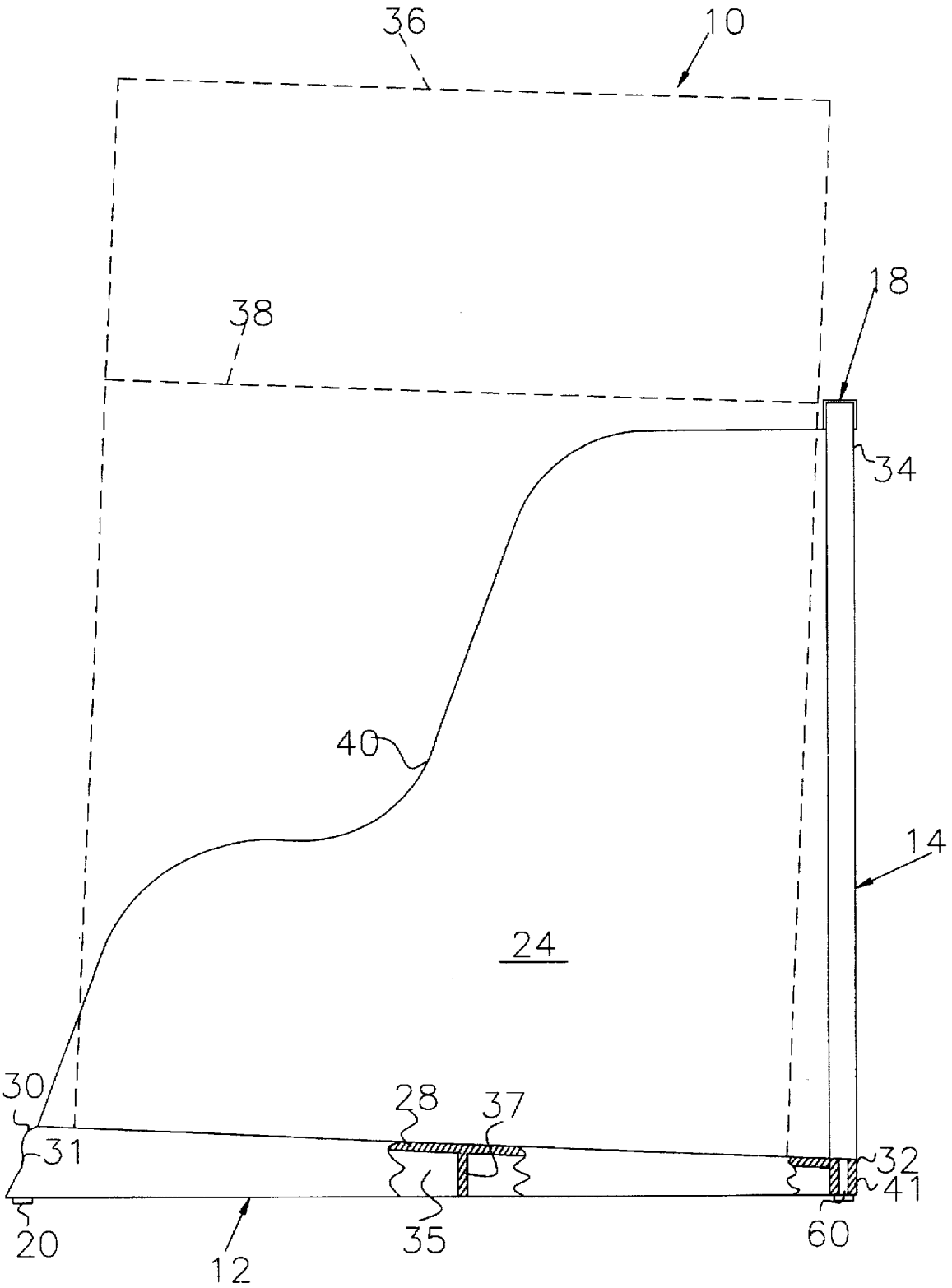
FIG. 3 is an end elevational view of the divider system of FIG. 1 partially cut away to show internal features thereof.

Referring now to the figures, particularly FIGS. 1 through 3, an embodiment of an adjustable divider unit according to the present invention is shown generally at 10 therein. In FIG. 1, for example, this unit 10 be is shown in a front elevation to have a base member 12 with an attached back member 14. Typically the base member 12 has a length of about nineteen inches and a depth of about eleven inches. The back member 14 typically will have the same length as the base member, and typically has a height of about eleven inches. Of course, these components can be fabricated with other dimensions. The back member 14 is shown as having a plurality of vertical slots 16, and a top cap 18 whose purpose will become apparent from the discussion below. If desired the base member 12 can be provided with a plurality of cushion members 20 to reduce a potential for movement of the unit 10 on a support surface (not shown) and/or marring of that support surface.

A top plan view of the unit 10 is shown in FIG. 2. It can be seen that the base member is provided with a plurality of rows (e.g. three rows) of slots 22 that are used to receive downward tabs (see FIG. 4) of dividers 24. While a plurality of dividers 24 are shown as being equally spaced apart, the separation of the slots 22 permits the selection of lateral spacing between the dividers An end view of unit 10 is shown in FIG. 3. In this embodiment it can be seen that a top surface 28 of the base member 12 is sloped downwardly from a front edge 30 toward a rear edge 32. The front edge 30 is typically provided with a curved recess 31. This facilitates, for example, placement of labels, etc. Typically the rear edge 32 is 0.5 inches lower than the front edge 30. It can also be seen that the back member 14 is substantially upright, and the cap 18 is affixed at the top edge 34. The back member 14 is generally free-standing, however, it can be placed flush with a wall surface. Items of two different sizes are indicated with phantom lines at 36 and 38 to illustrate how such items are retained in the unit 10 by the sloped surface 28. Each divider 24 is shown as having a reverse curved forward edge 40 to facilitate grasp of an item stored within the unit 10.

FIG. 3 is partially cut away to show features otherwise not seen in other figures. For example, the base member 12 has strengthening ribs 35, 37 on an underside of top surface 28. These ribs 35, 37 are formed integrally in the base member 12 using, for example, injection molding techniques. Also shown are slots 41 for receiving the lips 60 of the back member 14 (See FIG. 7).

Figure 4:
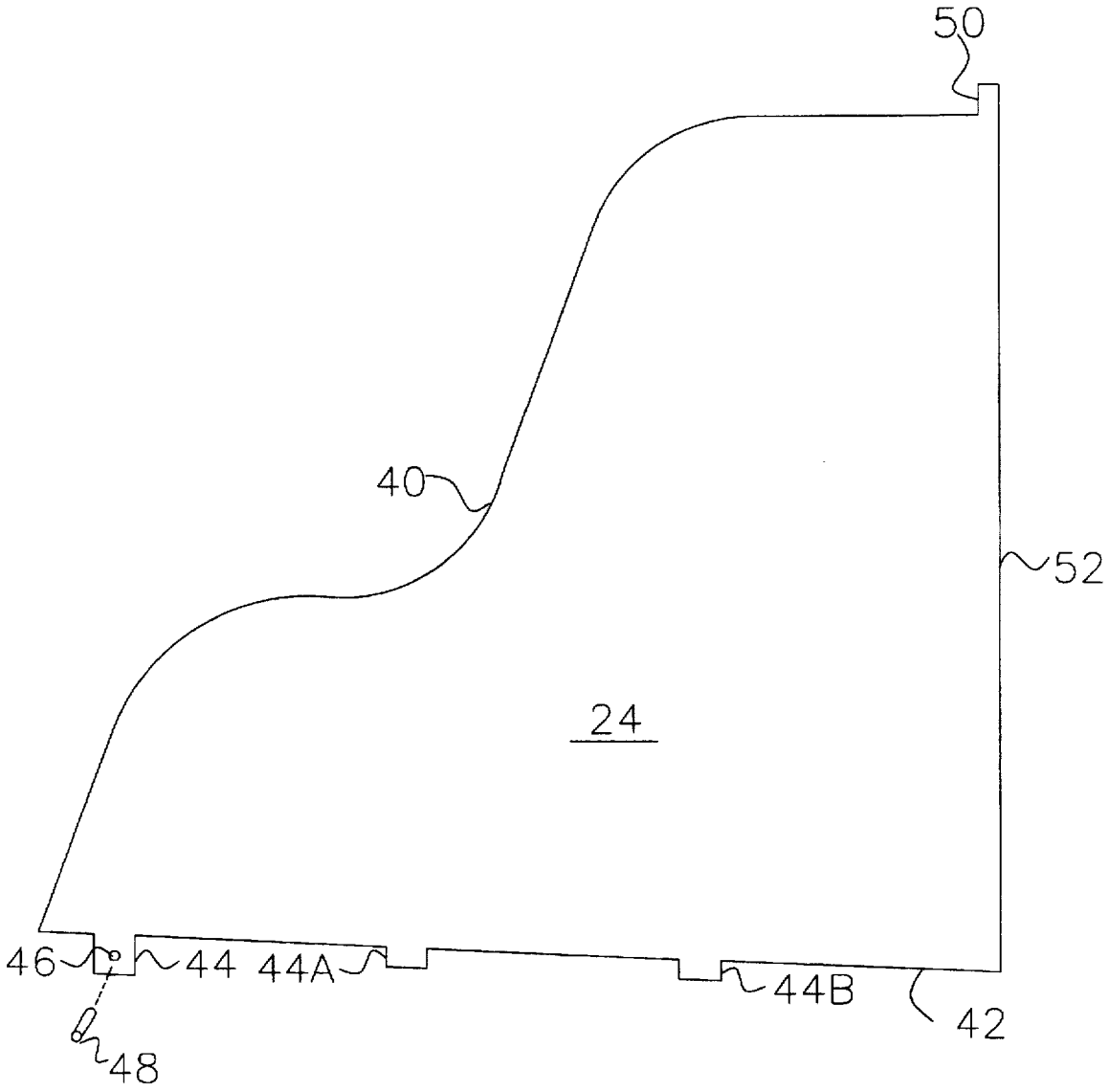
FIG. 4 is a side elevational view of a divider of the system of FIG. 1.

A side elevation of a single divider 24 is shown in FIG. 4. A lower edge 42 of this divider 24 is provided with projections as at 44 and 44A, 44B. These projections are spaced apart a distance to match the spacing of rows of slots 22 (see FIG. 2) in the base member 12. If desired, these projections 44, 44A and 44B, can be tapered (not shown) to assist in entrance into the slots 22. At least one projection, e.g., projection 44, is provided with an aperture 46 to receive a pin-type fastener 48 such that with that fastener 48 inserted, the fastener 48 prevents inadvertent removal of a divider 24 from the unit 10 However, the fastener 48 can be removed for disassembly of the divider unit. In addition, the divider 24 is provided with a top projection 50 that fits within the afore-mentioned cap 18 to prevent removal of a divider 24. The lower edge 42 is formed at an angle with respect to a rear edge 52 to conform to the angle between the top surface 28 of the base member 12 and the back member 14. Typically the divider 24 is about 0.13 inch thick.

FIGS. 5–7 provide information concerning the construction of the back member 14. This back member is preferably formed with longitudinal recesses to resemble corrugations. The forward face 54 contains the afore-mentioned slots 16 to receive the rearward edge 52 of the divider 24, with valleys 56 being formed in the rear surface. Typically the slots 16 are about 0.25 inch deep and 0.14 inch wide. This construction provides top-to-bottom rigidity.

Extending downwardly from the lower edge 58 of the back member 14 is a lip 60 which can be segmented, as shown. This lip 60 is provided with a plurality of openings 62 for receiving pin-type fasteners 64 to secure the back member 14 to the rearward edge 32 of the base member 12. In FIG. 7, the cap 18 is illustrated to further show its position atop the top edge 34 of the back member 14.

In a normal utilization of the present divider unit be, the back member 14 is attached to the rear edge 32 of the base member 12 by passing fasteners 64 through openings 62 in the lip 60 that extend into slots 41 (See FIG. 3) into that rear edge. A selected number of dividers 24 are positioned at selected spacings with their rear edge 52 in the slots 16 within the back member 14, and their lower projections 44, 44A and 44B into slots 22 of the base member 12. To prevent inadvertent removal of the dividers 24, the pin 48 can be inserted into its corresponding opening 46. Also, the top cap 18 is fitted over the top edge 34 of the back member 14 to engage the top projections 50 of the dividers 24. Thus, a divider unit be is formed that is rigid and needs no support against the rear of the back member 14. The divider unit be is then available for the storage of various materials (36, 38 of FIG. 3) in an upright manner. Such materials can be inserted or removed without changing the structure of the unit 1O until a different spacing is needed. Such change of spacing is accomplished by removing an appropriate pin 48 and lifting the forward edge of a divider 24 so as to disengage the projection 50 from the cap 18. Alternatively, the cap 18 could be removed for the removal of a divider 24. Labels for the individual spaces can be placed in the recess 31 of front edge 30.

From the foregoing, it will be seen that there is provided a divider unit wherein spacing between dividers thereof can be arranged for the storage of printed matter, and other objects, in a vertical orientation. The support surface for these items is sloped in a rearward direction to aid in preventing inadvertent removal of any one item. The divider unit is manufacturable by conventional plastic forming techniques, and thus can be manufactured in large numbers with simple equipment. The resultant divider unit, when assembled, is rigid and can support items of considerable weight. Typically, this adjustable divider unit is constructed of plastic. At least the base member and the back member can be formed using plastic molding techniques. The divider unit can be assembled without use of tools, screws or glue. Thus, it can be disassembled easily, also.

While certain relative dimensions are suggested by the figures, and typical dimensions are recited, the present invention is not limited to such dimensions. Rather, the invention is to be limited only by the appended claims and their equivalents.

I claim:

1. An adjustable divider unit for resting upon a support surface to hold items in a vertical orientation, said divider unit comprising:

a base member to be supported upon the support surface, said base member having a top surface to support the items, a front edge, and a rear edge, said top surface provided with a plurality of spaced-apart slots arranged in rows between said front and rear edges, said top surface being sloped downwardly from said front edge to said rear edge;

a back member attached to said rear edge of said base member, said back member being oriented substantially vertically, said back member being provided with a plurality of continuous slots extending from a bottom edge to an upper edge, said continuous slots being aligned with said spaced-apart slots in said rows;

a plurality of dividers each having a rear edge to be received in one of said continuous slots, and downwardly extending projections in a lower edge to be received in said spaced-apart slots, each of said dividers having a further projection in a top rear portion, each of said plurality of said dividers being provided with an opening through one of said projections in said lower edge of said dividers;

a fastener to further prevent inadvertent removal of said dividers, said fastener being received within said opening; and a cap to cover a top edge of said back member to encase said further projection of said dividers to prevent inadvertent removal of said dividers from said continuous slots.

2. The divider unit of claim 1 wherein said base member, said back member, said cap and said dividers are constructed from plastic.

3. An adjustable divider unit for resting upon a support surface to hold printed material in a vertical orientation, said divider unit comprising:

a base member to be supported upon the support surface, said base member having a top surface to support the items, a front edge, and a rear edge, said top surface provided with a plurality of spaced-apart slots arranged in rows between said front and rear edges, said top surface sloping downwardly from said front edge toward said rear edge;

a back member having a downwardly extending lip attached proximate said rear edge of said base member, said back member being oriented substantially vertically, said back member being provided with a plurality of continuous slots extending from a bottom edge to an upper edge, said continuous slots being aligned with said spaced-apart slots in said rows;

a plurality of dividers each having a rear edge to be received in one of said continuous slots, and downwardly extending projections in a lower edge to be received in said spaced-apart slots, each of said dividers having a further projection in a top rear portion, each of said plurality of said dividers being provided with an opening through one of said projections in said lower edge of said dividers;

a fastener to further prevent inadvertent removal of said dividers, said fastener being received within said opening; and a cap to cover a top edge of said back member to encase said further projection of said dividers to prevent inadvertent removal of said dividers from said continuous slots.

4. The divider unit of claim 3, wherein said base member, said back member, said cap and said dividers are constructed from plastic.

5. An adjustable divider unit for resting upon a support surface to hold notebooks of printed material in a vertical orientation, said divider unit comprising:

a base member to be supported upon the support surface, said base member having a top surface to support the items, a front edged and a rear edge, said top surface provided with a plurality of spaced-apart slots arranged in rows between said front and rear edges, said top surface sloping downwardly from said front edge toward said rear edge;

a back member having a downwardly extending lip, said lip provided with openings to accept fasteners to attach said back member proximate said rear edge of said base member, said back member being oriented substantially vertically, said back member formed with corrugations to provide a plurality of continuous slots extending from a bottom edge to an upper edge on a front surface and provide recesses in a rear surface to achieve vertical rigidity, said continuous slots being aligned with said spaced-apart slots in said rows;

a plurality of dividers each having a rear edge to be received in one of said continuous slots, and downwardly extending projections in a lower edge to be received in said spaced-apart slots with at least one of said downwardly extending projections being provided with an opening to receive a fastener, each said divider having a further projection in a top rear portion; and a cap to cover a top edge of said back member to encase said further projection of said dividers to prevent inadvertent removal of said dividers from said continuous slots.

6. The divider unit of claim 5, wherein at least said base member and said back member are constructed from molded plastic to achieve said sloped top surface of said base member and said corrugated surfaces of said back member.

7. An adjustable divider unit for resting upon a support surface to hold items in a vertical orientation, said divider unit comprising:

a base member to be supported upon the support surface, said base member having a top surface to support the items, a front edge, and a rear edge, said top surface provided with a plurality of spaced-apart slots arranged in rows between said front and rear edges, said top surface being sloped downwardly from said front edge to said rear edge;

a back member for attachment to said rear edge of said base member, said back member being oriented substantially vertically, said back member being provided with a plurality of continuous slots extending from a bottom edge to an upper edge, said continuous slots being aligned with said spaced-apart slots in said rows, said back member provided with a downwardly extending lip at a lower edge, said lip provided with a plurality of openings to receive fasteners to fasten said back member proximate said back edge of said base member;

a plurality of dividers each having a rear edge to be received in one of said continuous slots, and downwardly extending projections in a lower edge to be received in said spaced-apart slots, each of said dividers having an upwardly-extending further projection on a top rear portion; and a cap to cover a top edge of said back member to encase said further projection of said dividers to prevent inadvertent removal of said dividers from said continuous slots.

8. An adjustable divider unit for resting upon a support surface to hold items in a vertical orientation, said divider unit comprising:

a base member to be supported upon the support surface, said base member having a top surface to support the items, a front edge, and a rear edge, said top surface provided with a plurality of spaced-apart slots arranged in rows between said front and rear edges, said top surface being sloped downwardly from said front edge to said rear edge;

a back member attached to said rear edge of said base member, said back member being oriented substantially vertically, said back member being provided with a plurality of continuous slots extending from a bottom edge to an upper edge, said back member being corrugated to provide said continuous slots in said front surface and provide recesses in a back surface to provide vertical rigidity to said back member, said continuous slots being aligned with said spaced-apart slots in said rows;

a plurality of dividers each having a rear edge to be received in one of said continuous slots, and downwardly extending projections in a lower edge to be received in said spaced-apart slots, each of said dividers having a further projection in a top rear portion; and a cap to cover a top edge of said back member to encase said further projection of said dividers to prevent inadvertent removal of said dividers from said continuous slots and to provide longitudinal rigidity to said back member.

9. The divider unit of claim 8 wherein said base member, said back member, said cap and said dividers are constructed from plastic.

10. An adjustable divider unit for resting upon a support surface to hold printed material in a vertical orientation, said divider unit comprising:

a base member to be supported upon the support surface, said base member having a top surface to support the items, a front edge, and a rear edge, said top surface provided with a plurality of spaced-apart slots arranged in rows between said front and rear edges, said top surface being sloped downwardly from said front edge to said rear edge;

a back member having a downwardly extending lip attached proximate said rear edge of said base member, said back member being oriented substantially vertically, said back member being provided with a plurality of continuous slots extending from a bottom edge to an upper edge, said back member being corrugated to provide said continuous slots in said front surface and provide recesses in a back surface to provide vertical rigidity to said back member, said continuous slots being aligned with said spaced-apart slots in said rows;

a plurality of dividers each having a rear edge to be received in one of said continuous slots, and downwardly extending projections in a lower edge to be received in said spaced-apart slots, each of said dividers having a further projection in a top rear portion; and a cap to cover a top edge of said back member to encase said further projection of said dividers to prevent inadvertent removal of said dividers from said continuous slots and to provide longitudinal rigidity to said back member.

11. The divider unit of claim 10 wherein said base member, said back member, said cap and said dividers are constructed from plastic.

* * * * *